US012398600B2

(12) United States Patent
Revheim et al.

(10) Patent No.: US 12,398,600 B2
(45) Date of Patent: Aug. 26, 2025

(54) DUAL TUBING LOCATING ADAPTOR FOR A TUBING STRING

(71) Applicant: Schlumberger Technology Corporation, Sugar Land, TX (US)

(72) Inventors: Kjell Revheim, Bucharest (RO); Jose Francisco Hurtado, Rosharon, TX (US); Mikhail V. Gotlib, Rosharon, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 18/716,024

(22) PCT Filed: Dec. 13, 2022

(86) PCT No.: PCT/US2022/052636
§ 371 (c)(1),
(2) Date: Jun. 3, 2024

(87) PCT Pub. No.: WO2023/121910
PCT Pub. Date: Jun. 29, 2023

(65) Prior Publication Data

US 2025/0034958 A1 Jan. 30, 2025

Related U.S. Application Data

(60) Provisional application No. 63/293,222, filed on Dec. 23, 2021.

(51) Int. Cl.
*E21B 41/00* (2006.01)
*E21B 17/10* (2006.01)

(52) U.S. Cl.
CPC ..... *E21B 17/1078* (2013.01); *E21B 41/0035* (2013.01)

(58) Field of Classification Search
CPC ... E21B 41/0035; E21B 41/0042; E21B 17/18
See application file for complete search history.

(56) References Cited

U.S. PATENT DOCUMENTS

| | | | | |
|---|---|---|---|---|
| 6,315,054 | B1 | 11/2001 | Brunet | |
| 7,513,302 | B2 | 4/2009 | Cassidy | |
| 8,256,517 | B2 | 9/2012 | Ingraham | |
| 8,286,699 | B2 | 10/2012 | Ingraham | |
| 2010/0170677 | A1 | 7/2010 | Ingraham | |
| 2013/0140019 | A1 | 6/2013 | Pare | |
| 2015/0233190 | A1* | 8/2015 | Wolf | E21B 41/0035 166/380 |

* cited by examiner

*Primary Examiner* — Giovanna Wright
(74) *Attorney, Agent, or Firm* — Jeffrey D. Frantz

(57) ABSTRACT

A dual tubing locating adapter ("DLTA") for use with a mule shoe. The DLTA may include a housing, a primary tubing string, a lateral tubing string, and a retention mechanism. The primary tubing string may be positioned at least partially within the DLTA. The lateral tubing string may be positioned at least partially within the DLTA and retained within the DLTA via a shear mechanism. The retention mechanism may be operable to retain the lateral tubing string within the DLTA as the DLTA is landed on the mule shoe.

14 Claims, 9 Drawing Sheets

DUAL TUBING LOCATING ADAPTOR FOR A TUBING STRING

CROSS-REFERENCE TO RELATED APPLICATIONS

This application is a National Stage Entry of International Patent Application No. PCT/US2022/052636, filed Dec. 13, 2022, which claims the benefit of U.S. Provisional Application No. 63/293,222 entitled "Dual Tubing Locating Adaptor with Lateral Bore and Main Bore Tubing Strings," filed Dec. 23, 2021, the disclosure of which is incorporated herein by reference in its entirety.

BACKGROUND

A wellbore may be drilled into the ground to explore and produce a hydrocarbon reservoir therein. This wellbore may be referred to as the main or primary wellbore. To further explore and/or increase production from the reservoir, one or more lateral wellbores may be drilled which branch from the main wellbore. Such drilling extends the reach of the well into laterally displaced portions of the reservoir.

During downhole operations, it may be necessary to separately and selectively enter the main and lateral wellbores with a wellbore tubular or tubulars. The wellbore tubulars, or tubing strings, can be used to establish flow or access paths in the multiple wellbores. For example, production strings can be guided to the main and lateral wellbores, and sealed, to provide fluid flow paths from the multiple wellbores into the primary well extending to the surface.

SUMMARY

A dual tubing locating adapter ("DLTA") for use with a mule shoe according to one or more embodiments of the present disclosure includes a housing, a primary tubing string, a lateral tubing string, and a retention mechanism. The primary tubing string is positioned at least partially within the DLTA. The lateral tubing string is positioned at least partially within the DLTA and retained within the DLTA via a shear mechanism. The retention mechanism is operable to retain the lateral tubing string within the DLTA as the DLTA is landed on the mule shoe.

A production tubing system for use within a wellbore according to one or more embodiments of the present disclosure includes a mule shoe disposable within the wellbore and a DLTA. The DLTA includes a housing, a primary tubing string, a lateral tubing string, and a retention mechanism. The primary tubing string is positioned at least partially within the DLTA. The lateral tubing string is positioned at least partially within the DLTA and retained within the DLTA via a shear mechanism. The retention mechanism is operable to retain the lateral tubing string within the DLTA as the DLTA is landed on the mule shoe.

A method of completing a wellbore according to one or more embodiments of the present disclosure includes positioning a mule shoe within a wellbore. The method further includes running a DLTA comprising a primary tubing string and a lateral tubing string into the wellbore. The method also includes landing the DLTA on the mule shoe while retaining the lateral tubing string at least partially within the DLTA via a retention mechanism and a shear mechanism However, many modifications are possible without materially departing from the teachings of this disclosure. Accordingly, such modifications are intended to be included within the scope of this disclosure as defined in the claims.

BRIEF DESCRIPTION OF THE DRAWINGS

Certain embodiments of the disclosure will hereafter be described with reference to the accompanying drawings, wherein like reference numerals denote like elements. It should be understood, however, that the accompanying figures illustrate the various implementations described herein and are not meant to limit the scope of various described technologies. The drawings are as follows.

DETAILED DESCRIPTION

In the following description, numerous details are set forth to provide an understanding of some embodiments of the present disclosure. However, it will be understood by those of ordinary skill in the art that that embodiments of the present disclosure may be practiced without these details and that numerous variations or modifications from the described embodiments may be possible.

In the specification and appended claims: the terms "connect," "connection," "connected," "in connection with," "connecting," "couple," "coupled," "coupled with," and "coupling" are used to mean "in direct connection with" or "in connection with via another element." As used herein, the terms "up" and "down," "upper" and "lower," "upwardly" and "downwardly," "upstream" and "downstream," "uphole" and "downhole," "above" and "below," and other like terms indicating relative positions above or below a given point or element are used in this description to more clearly describe some embodiments of the disclosure.

Figure 1:
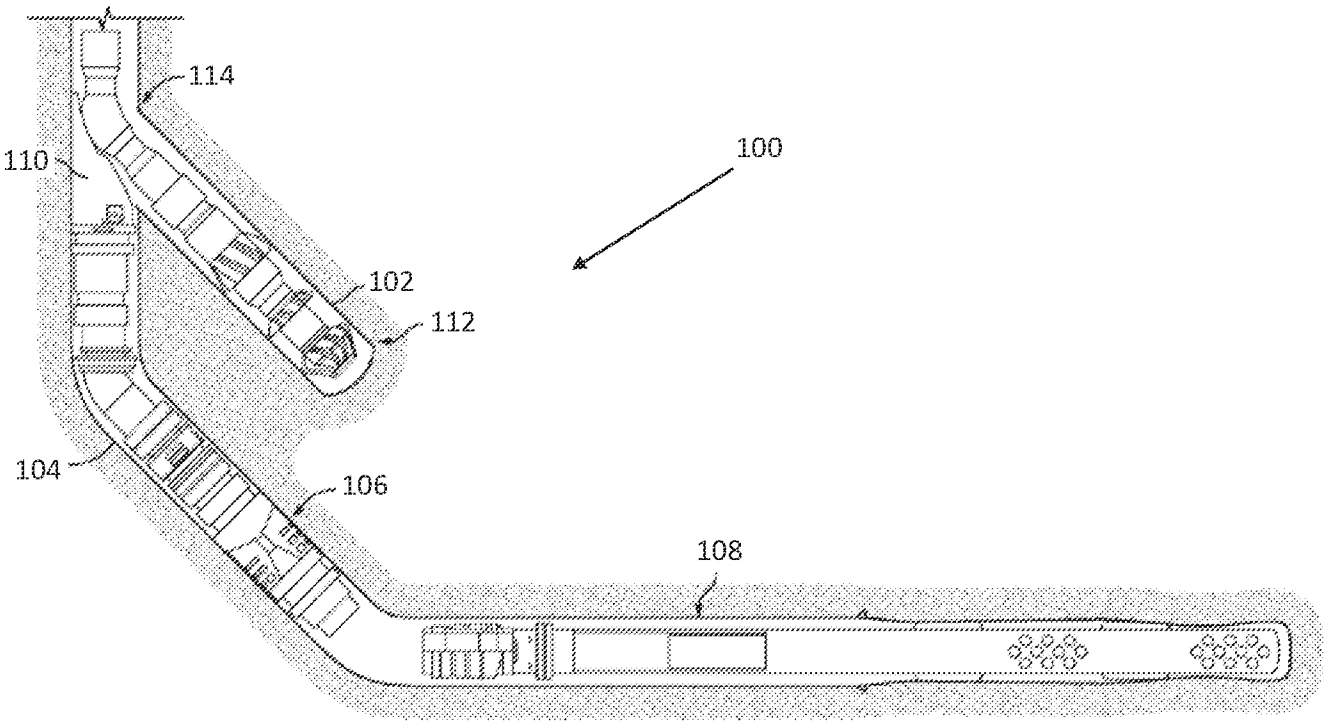
FIG. 1 is a schematic view of a system for milling and drilling a lateral wellbore from a primary wellbore according to one or more embodiments of the present disclosure.
Figure 2:
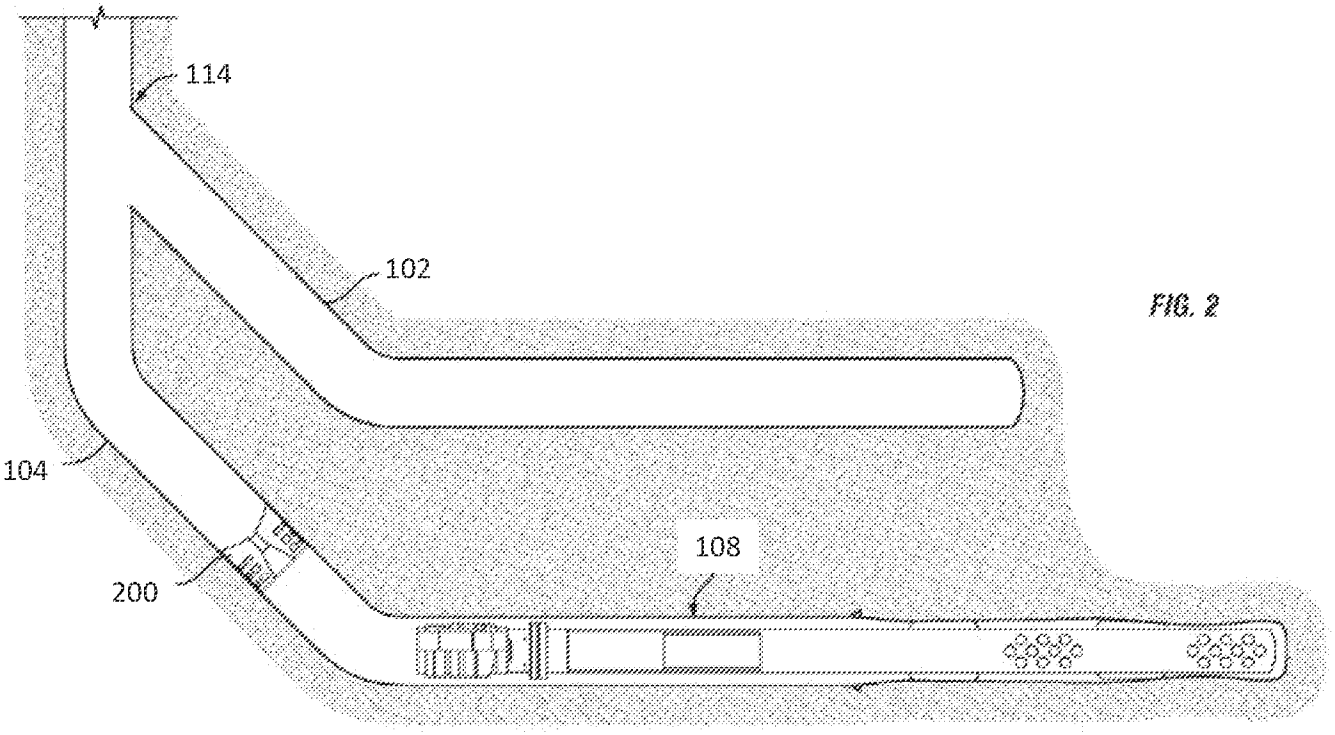
FIG. 2 is a schematic view of the finished junction between the lateral wellbore and the primary wellbore including downhole operations equipment according to one or more embodiments of the present disclosure.

Referring initially to FIG. 1, FIG. 1 is a system 100 for milling and drilling a lateral wellbore 102 from a primary wellbore 104. A primary or main wellbore 104 is drilled in a conventional manner and may include operational equipment 106, such as a whipstock and anchor system, or a fracturing and/or production system 108. A diverter or whipstock 110 is used to guide a milling and/or drilling assembly 112 laterally relative to the primary wellbore 104 for creating a lateral or secondary wellbore 102 having a junction 114 with the primary wellbore 104. After the junction and lateral wellbore are complete, well treatment, completion or production equipment 108 may remain in the primary wellbore 104 along with an orientator or locator 200 for receiving additional downhole tools, as shown in FIG. 2.

Figure 3:
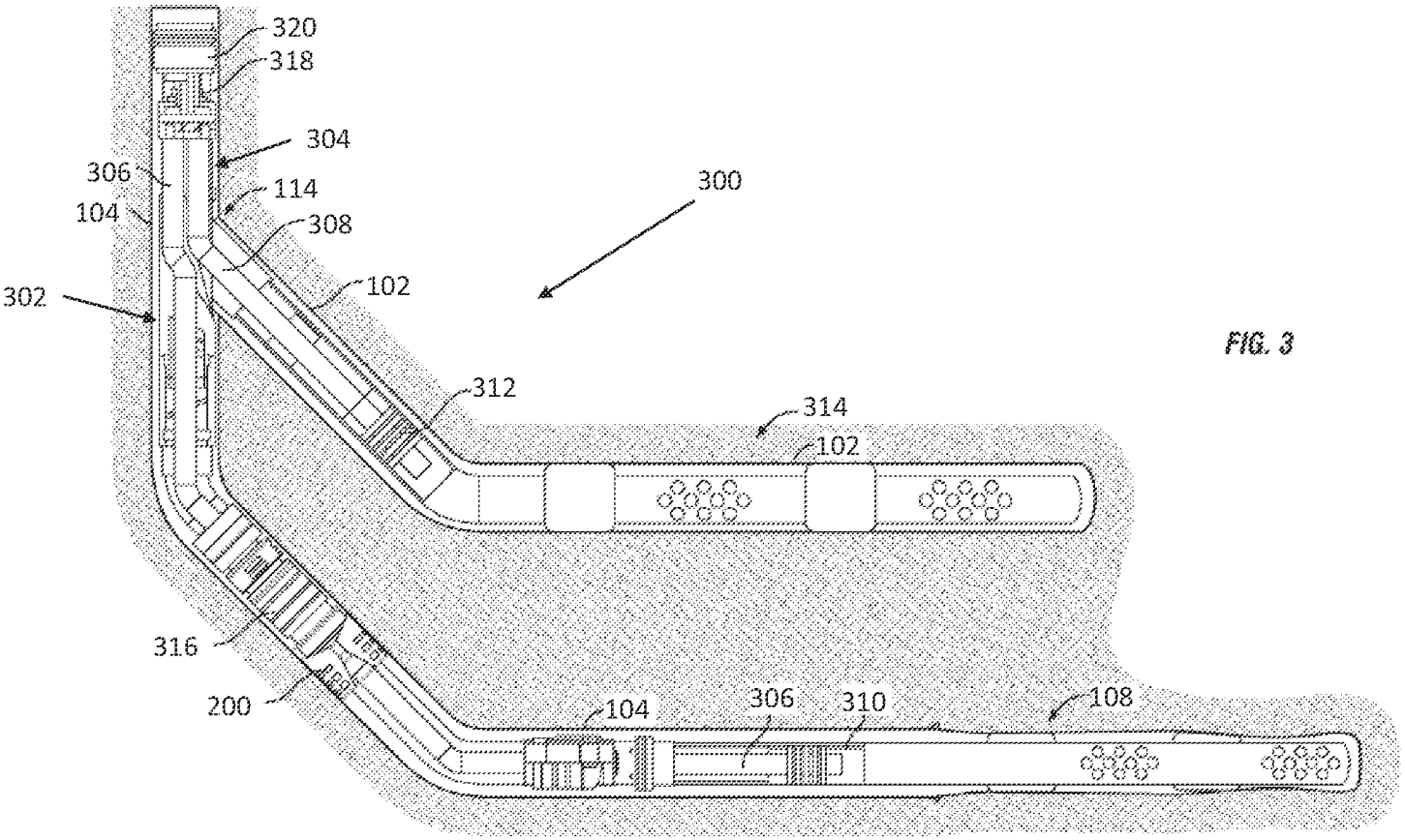
FIG. 3 is a schematic view of an embodiment of a production tubing assembly according to one or more embodiments of the present disclosure.

Referring now to FIG. 3, FIG. 3 is a production tubing system 300 according to one or more embodiments of the present disclosure. The production tubing assembly 300 is adapted for providing a pressure seal, which isolates the lateral wellbore 102 from the main wellbore 104 and vice versa, to the two (or multiple) bores for production access. In one or more embodiments, the production tubing system 300 aligns on a mule shoe 302 downhole and latches to the top of the junction 114. When latched, a dual tubing locating adapter ("DLTA") 304 with dual strings 306, 308 advances into the junction 114.

Once the DLTA 304 is in place in the junction 114, the DLTA selectively guides the strings 306, 308 into the main and lateral bores 104. The primary bore string 306 lands in a polished bore receptacle 310 of the primary bore production equipment 108 and the lateral bore string 308 lands in a polished bore receptacle 312 of the secondary bore production equipment 314. For purposes of simplicity and clarity, the strings 306, 308 and the equipment 108, 314 will be referred to as production strings and equipment, though other tubular members and downhole equipment are contemplated. The positioned production tubing assembly 300 and production strings 306, 308 will effect a seal in the bores of the production equipment 108, 314 in the main and lateral wellbores 104, 102 to complete the well. A packer assembly 316 and other downhole equipment may also be provided in the wellbores 104, 102.

In some embodiments, a diverter 318 is disposed at the top of the production tubing assembly 300 that selectively allows access to either bore for future intervention work needed downhole. The diverter 318 may stay in place and can be rotated by means of multi-cycle "J" grooves to allow access to the desired bore. A packer 320, with a seal bore receptacle, is set at the top of the production tubing assembly 300 to lock the assembly in place. If another junction is created in the main wellbore 104 above the original junction 114, a packer is provided to seal access to the lower junction 114, making the production tubing assembly 300 stackable.

Figure 4:
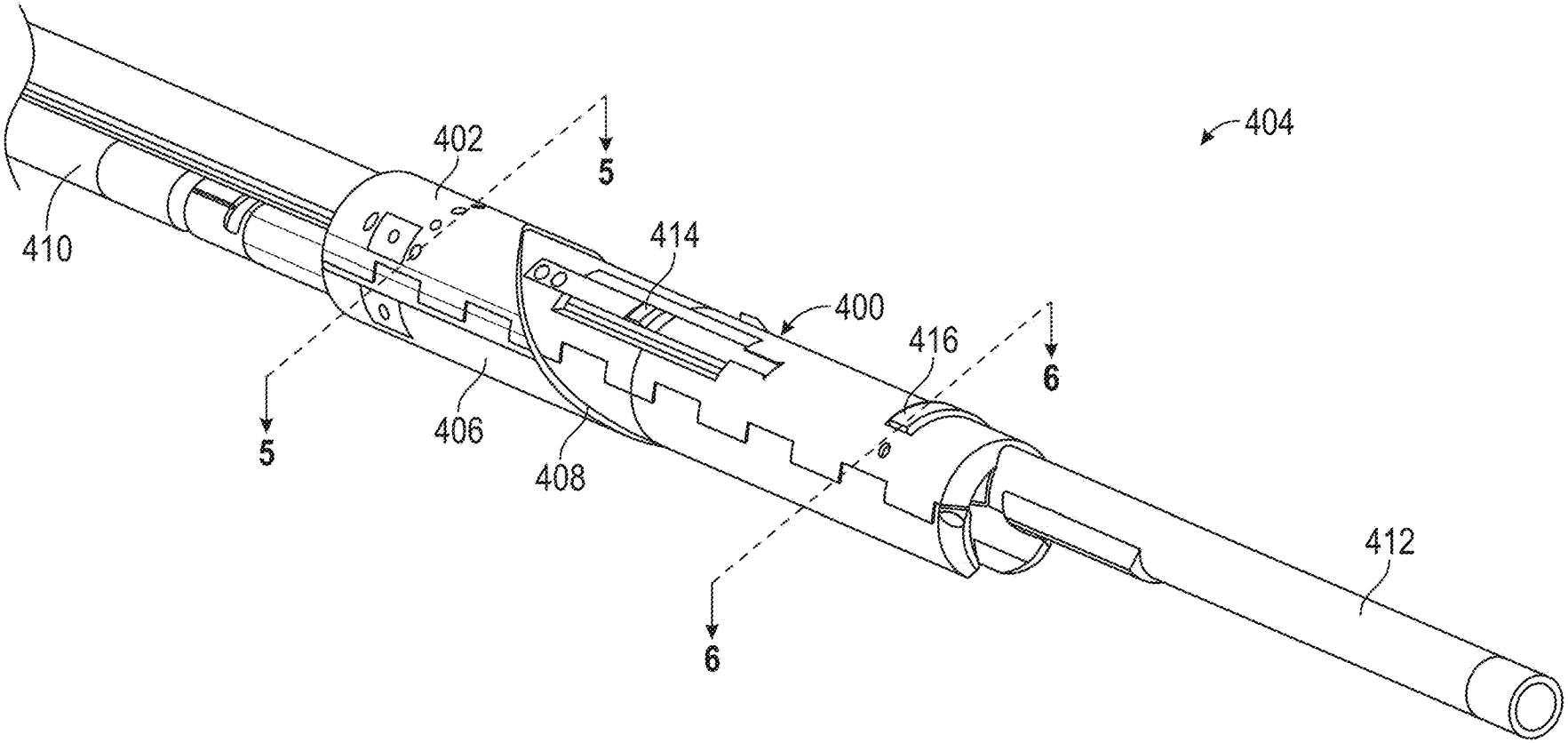
FIG. 4 is an isometric view of a dual tubing locating adapter ("DLTA") according to one or more embodiments of the present disclosure.

Referring now to FIG. 4, FIG. 4 is an isometric view a DLTA 404 according to one or more embodiments of the present disclosure. In one or more embodiments, the DLTA 404 includes a housing 400 made of an upper portion 402 and a lower portion 406 joined via pins, screws, or similar connectors. Additionally, a mule shoe ramp 408 is formed on the exterior of the housing 400 to align the DLTA on a mule shoe, as described in more detail below. A primary tubing string 410 and the lateral tubing string 412 extend through the housing 400. The DLTA 404 also includes locking collet fingers 414 to couple the DLTA 404 to a mule shoe once the DLTA 404 is landed and a retention mechanism 416 to prevent premature release of the lateral tubing string 412, as described in more detail below.

Figure 5:
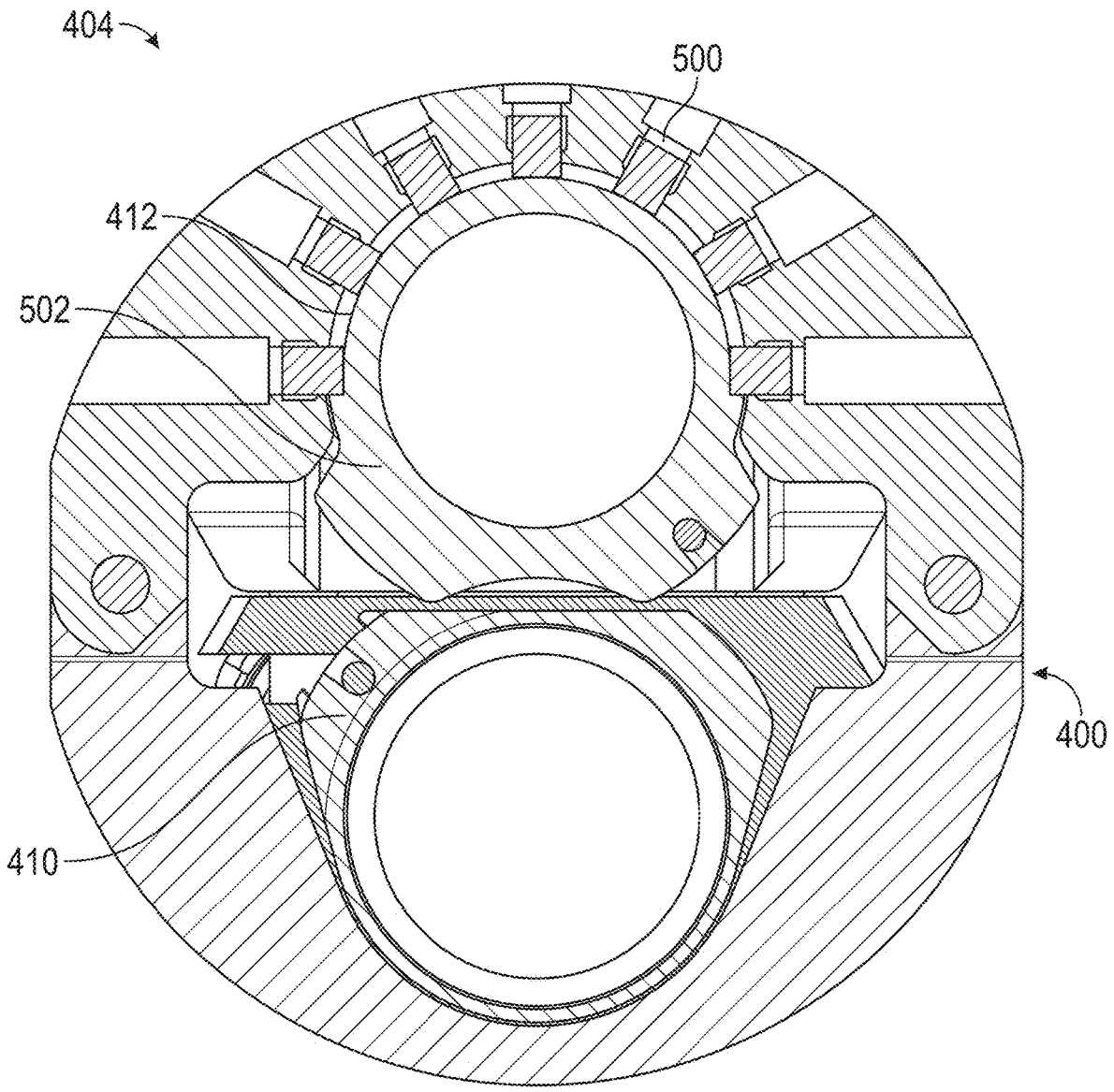
FIG. 5 is a cross-sectional view of the DLTA of FIG. 4 along line A-A.

Turning now to FIG. 5, FIG. 5 is a cross-sectional view of the DLTA 404 of FIG. 4 along line A-A. In one or more embodiments, the housing 400 is positioned around the primary tubing string 410 and the lateral tubing string 412. The lateral tubing string 412 includes two protrusions 502 extending at least a portion of the length of the lateral tubing string 412 to prevent relative rotation between the lateral tubing string and the DLTA 404. In other embodiments, the lateral tubing string 412 may include one, three, or more protrusions 502 to prevent relative motion between the lateral tubing string 412 and the DLTA 404. The lateral tubing string is retained within the housing via a shear mechanism 500, such as shear screws extending through the housing 400. Once the DLTA 404 is landed on the mule shoe, as described in more detail below, the shear mechanism is sheared to allow the lateral tubing string to extend into the lateral wellbore.

Figure 6:
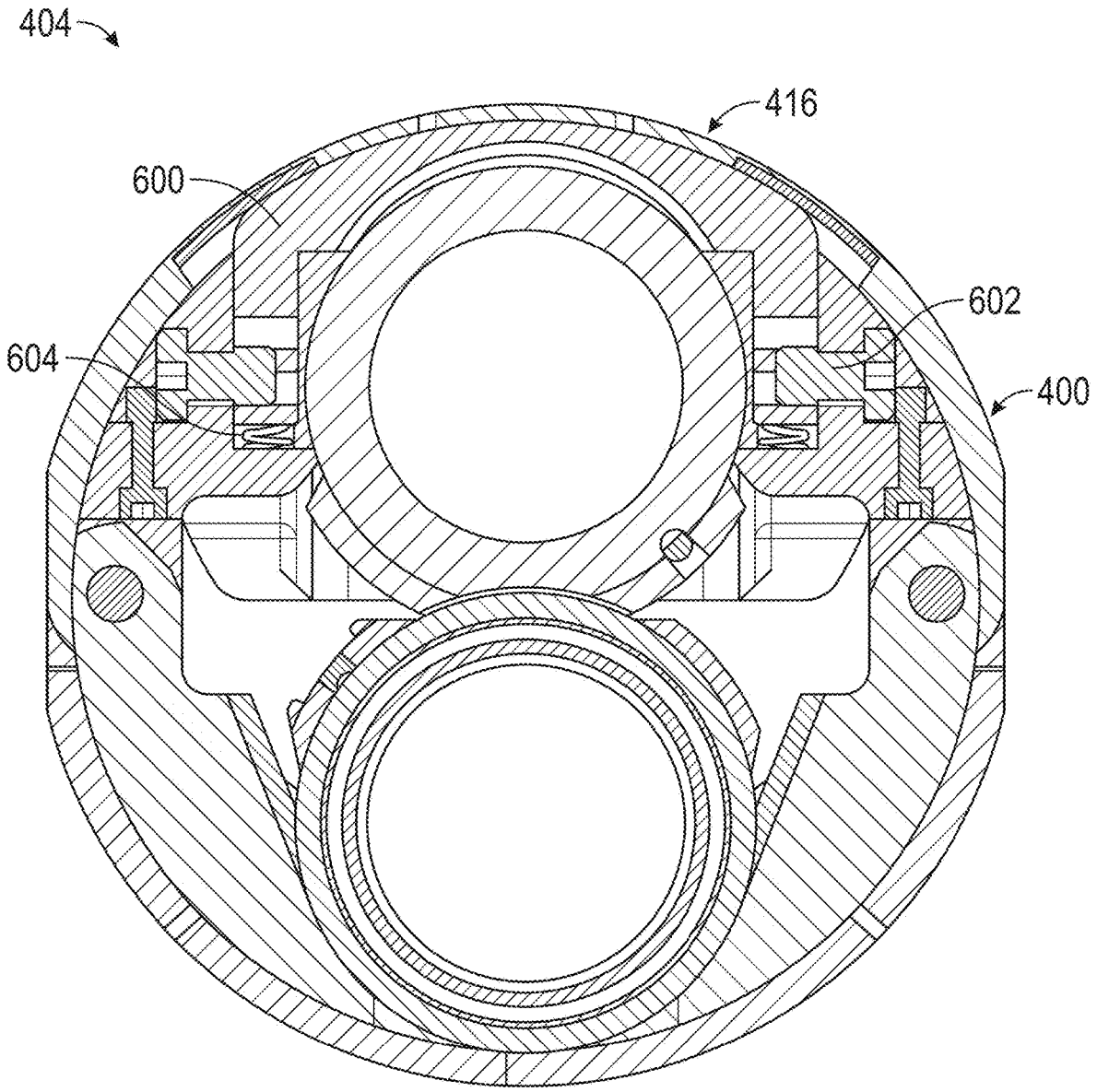
FIG. 6 is a cross-sectional view of the DLTA of FIG. 4 along line B-B.
Figure 7:
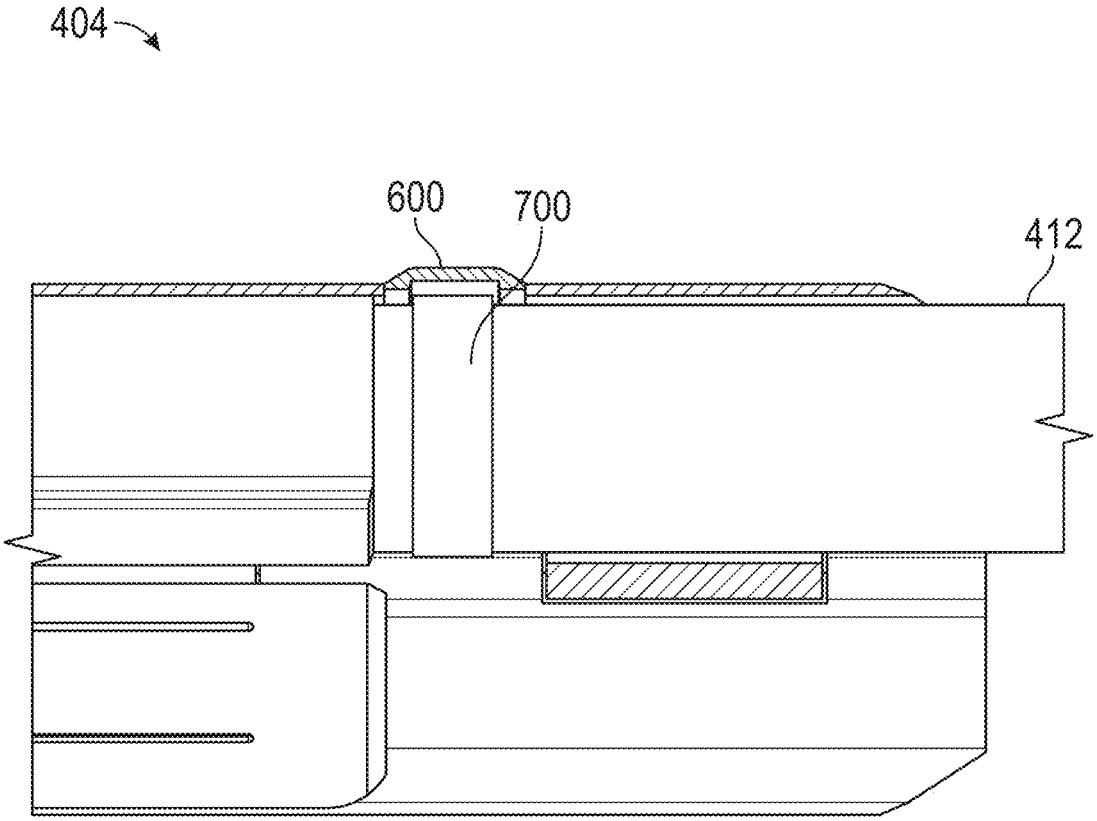
FIG. 7 is an enlarged, partial cross-sectional view of the DLTA of FIG. 4.
Figure 8:
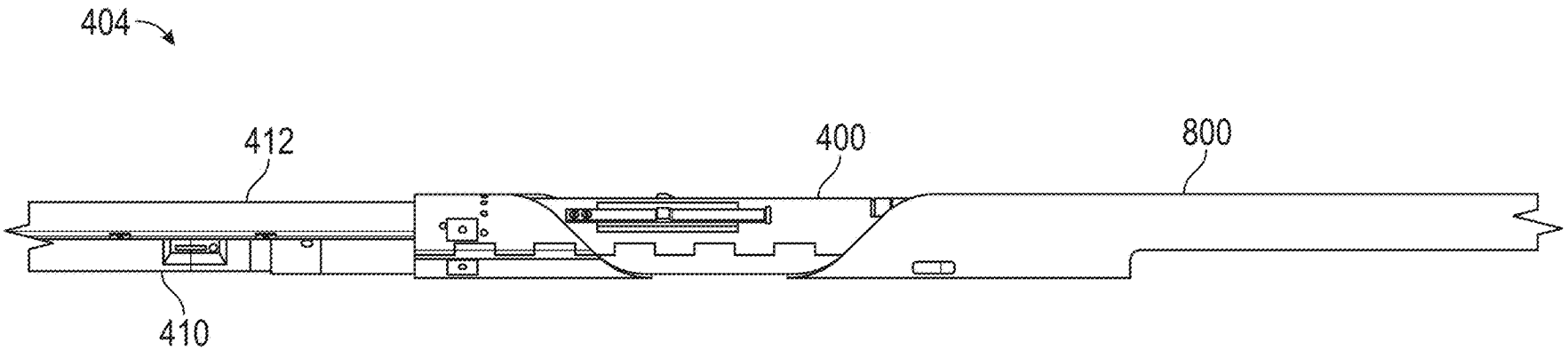
FIG. 8 is a side view of the DLTA of FIG. 4 in the process of landing on a mule shoe.

Turning now to FIG. 6, FIG. 6 is a cross-sectional view of the DLTA 404 of FIG. 4 along line B-B. As shown in FIG. 6, the retention mechanism 416 includes a lug 600 retained partially within the housing 400 via retaining pins 602 or a similar mechanism and the lug 600 is biased radially outward via a biasing mechanism 604, such as a spring. As shown more clearly in FIGS. 7 and 8, the lug 600 extends beyond the housing 400 such that when the DLTA begins to land on the mule shoe 800, the lug is shifted via the mule shoe 800 and engages with a retention profile 700 formed on the lateral tubing string 412. This allows the lug 600 to retain the lateral tubing string 412 within the DLTA 404 as the DLTA 404 is landed.

Figure 9:
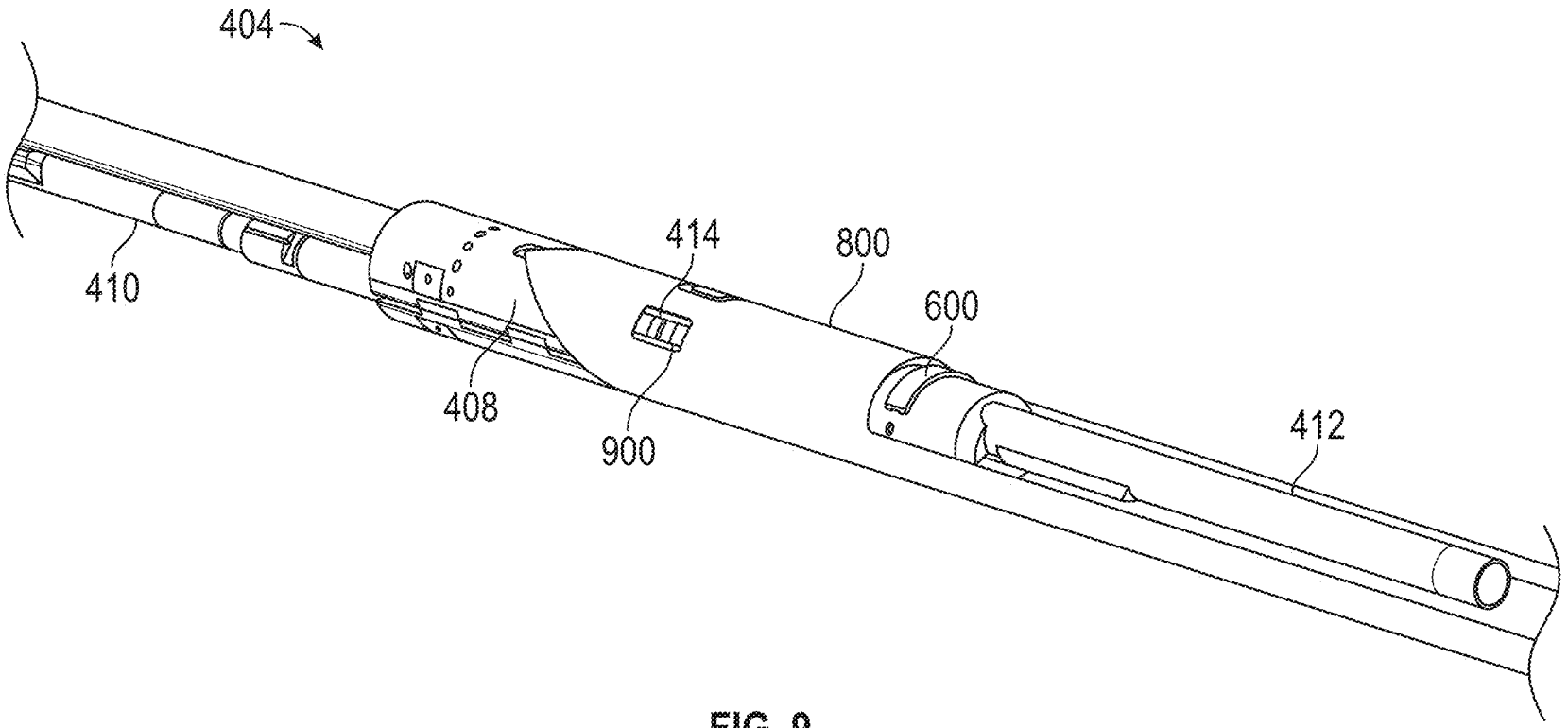
FIG. 9 is an isometric view of the DLTA of FIG. 4 in a landed position on the mule shoe.

Once the DLTA 404 is landed and aligned via the mule shoe 800 and the mule shoe ramp 408, the lug 600 is exposed, as shown in FIG. 9. Once the lug is exposed, the biasing mechanism 604 extends the lug 600 away from the lateral tubing string 412, allowing the lateral tubing string 412 to extend into the lateral wellbore, as described above. Additionally, the collet fingers 414 of the DLTA extend through slots 900 formed in the mule shoe 800 to couple the DLTA 404 to the mule shoe 800. In one or more embodiments, once the DLTA is landed on the mule shoe, the primary tubing string 410 extends into the primary wellbore, as described above.

As used herein, a range that includes the term between is intended to include the upper and lower limits of the range; e.g., between 50 and 150 includes both 50 and 150. Additionally, the term "approximately" includes all values within 5% of the target value; e.g., approximately 100 includes all values from 95 to 105, including 95 and 105. Further, approximately between includes all values within 5% of the target value for both the upper and lower limits; e.g., approximately between 50 and 150 includes all values from 47.5 to 157.5, including 47.5 and 157.5.

Although a few embodiments of the disclosure have been described in detail above, those of ordinary skill in the art will readily appreciate that many modifications are possible without materially departing from the teachings of this disclosure. Accordingly, such modifications are intended to be included within the scope of this disclosure as defined in the claims.

What is claimed is:

1. A dual tubing locating adapter ("DLTA") for use with a mule shoe, the DLTA comprising:

a housing;

a primary tubing string positioned at least partially within the DLTA;

a lateral tubing string positioned at least partially within the DLTA and retained within the DLTA via a shear mechanism; and a retention mechanism operable to retain the lateral tubing string within the DLTA as the DLTA is landed on the mule shoe, wherein the retention mechanism comprises:

a lug retained within the housing and shiftable to engage with a retention profile formed on the lateral tubing string to retain the lateral tubing string within the DLTA; and a biasing mechanism to bias the lug radially outward, wherein the lug is configured to be compressed via the mule shoe when landing the DLTA on the mule shoe such that the lug engages with the retention profile formed on the lateral tubing string to retain the lateral tubing string within the DLTA.

2. The DLTA of claim 1, wherein the housing further comprises a mule shoe ramp formed on an exterior of the housing to align the DLTA with the mule shoe.

3. The DLTA of claim 1, wherein the biasing mechanism comprises a spring.

4. The DLTA of claim 1, further comprising collet fingers positioned to couple the DLTA with the mule shoe once the DLTA is landed on the mule shoe.

5. The DLTA of claim 1, wherein the shear mechanism comprises shear screws extending through the housing to retain the lateral tubing string within the DLTA.

6. The DLTA of claim 1, wherein the housing comprises an upper portion coupled to a lower portion.

7. A production tubing system for use within a wellbore; the production tubing system comprising:

a mule shoe disposable within the wellbore; and a dual tubing locating adapter ("DLTA") disposable within the wellbore and comprising:

a housing;

a primary tubing string positioned at least partially within the DLTA;

a lateral tubing string positioned at least partially within the DLTA and retained within the DLTA via a shear mechanism; and a retention mechanism operable to retain the lateral tubing string within the DLTA as the DLTA is landed on the mule shoe, wherein the retention mechanism comprises:

a lug retained within the housing and shiftable to engage with a retention profile formed on the lateral tubing string to retain the lateral tubing string within the DLTA; and a biasing mechanism to bias the lug radially outward, wherein the lug is configured to be compressed via the mule shoe when landing the DLTA on the mule shoe such that the lug engages with the retention profile formed on the lateral tubing string to retain the lateral tubing string within the DLTA.

8. The production tubing system of claim 7, wherein the housing further comprises a mule shoe ramp formed on an exterior of the housing to align the DLTA with the mule shoe.

9. The production tubing system of claim 7, wherein the biasing mechanism comprises a spring.

10. The production tubing system of claim 7, wherein the DLTA further comprises collet fingers positioned to couple the DLTA with the mule shoe once the DLTA is landed on the mule shoe.

11. The production tubing system of claim 7, wherein the shear mechanism comprises shear screws extending through the housing to retain the lateral tubing string within the DLTA.

12. The production tubing system of claim 7, wherein the housing comprises an upper portion coupled to a lower portion.

13. A method of completing a well, the method comprising:

positioning a mule shoe within a wellbore;

running a dual tubing locating adapter ("DLTA") comprising a primary tubing string and a lateral tubing string into the wellbore;

landing the DLTA on the mule shoe while retaining the lateral tubing string at least partially within the DLTA via a retention mechanism and a shear mechanism; and biasing a lug of the retention mechanism radially outward via a biasing mechanism, wherein landing the DLTA on the mule shoe further comprises compressing the lug via the mule shoe such that the lug engages with a retention profile formed on the lateral tubing string to retain the lateral tubing string within the DLTA.

14. The method of claim 13, further decompressing the lug of the retention mechanism radially outward to allow the lateral tubing string to be positioned within a lateral wellbore of the well.

* * * * *